United States Patent [19]

Volino

[11] Patent Number: 4,744,258

[45] Date of Patent: May 17, 1988

[54] NON-INDEXING ENGINE STARTER GEARING

[75] Inventor: Nicholas A. Volino, Elmira, N.Y.

[73] Assignee: Facet Enterprises, Inc., Tulsa, Okla.

[21] Appl. No.: 940,265

[22] Filed: Dec. 11, 1986

[51] Int. Cl.[4] ..... F02N 15/06

[52] U.S. Cl. ..... 74/7 R; 74/6; 192/42

[58] Field of Search ..... 74/6, 7 R, 7 A, 7 C; 192/42

[56] References Cited

U.S. PATENT DOCUMENTS 3,263,509 8/1966 Digby ..... 74/6

3,714,834 2/1973 Digby ..... 74/6

3,915,020 10/1975 Johnson ..... 74/6

4,019,393 4/1977 Mortensen ..... 74/6

*Primary Examiner*—Allan D. Herrmann

*Attorney, Agent, or Firm*—Remy J. VanOphem

[57] ABSTRACT

Engine starter gearing of the positive shift dentil type clutch with a resilient member to absorb the torsional loads on the starter gearing upon its engagement, the starter gearing having a sleeve member with a straight spline on its inside surface and a helical spline on its outside surface whereby torque is imposed on a driving clutch member, the driving clutch member having an inside surface with a notch therein, a lock ring being positioned in the notch and engaging the sleeve member to fixedly position the sleeve member with respect to the driven clutch member.

8 Claims, 2 Drawing Sheets

NON-INDEXING ENGINE STARTER GEARING

BACKGROUND OF THE INVENTION

1. Field of the Invention

This invention relates to the field of engine starter gearing. More particularly, this invention relates to engine starter gearing of the non-indexing, positive shift dentil teeth type overrunning clutch starter gearing.

2. Description of the Prior Art

Clutches of the general type described herein above are well known in the art, but the art teaches that such drives require rather complicated mechanisms to separate the dentils of the overrunning clutch. An example of such drive is illustrated in U.S. Pat. No. 3,263,509, by Digby, assigned to the assignee hereof. Such starter gearing mechanisms as illustrated in the above noted letters patent renders these drives suitable only for large engine installations, primarily large volume displacement diesel engines. A similar type of overrunning clutch suitable for smaller engine installations, i.e., engine installations requiring less than 70 ft. lb. of steady state torque during cranking, is illustrated in U.S. Pat. No. 3,714,834 by Digby, also assigned to the assignee hereof. Initial development criteria of the smaller engine drive starters required the removing of the complicated dentil separation mechanism and reducing the drive in size in order to meet the objectives of suitability for smaller engine installations. However, such starter gearing suffered from a major defect, that is, the drive which was initially very reliable, eventually (within as little as one-fifth of its expected life) began to suffer an impositiveness in engagement with the engine to be started. Initial examination of such drives has shown that a tooth abutment between the pinion gear and the gear of the engine to be started prevented engagement of the drive and allowed sufficient axial movement of the shifting mechanism for the starter motor contacts to be closed, thereby causing the power shaft to rotate. Such action occurring without the interengagement of the pinion and the ring gear of the engine resulted in tooth milling, either of the ring gear or of the pinion gear, which thereafter required expensive and time consuming replacement. To solve this initial problem, it was believed that the use of a bearing sleeve underneath the pinion gear, as well as a thrust bearing interconnecting the pinion gear and starter gearing sleeve which couples the starter gearing to the rotary power shaft, would eliminate this problem. By providing an intermediate low friction member, or washer, between a high speed rotating pinion and a comparatively low speed rotating body (the bearing sleeve) the amount of rotary energy being transmitted from the pinion to the sleeve was minimized. However, the use of the bearing sleeve in conjunction with the thrust body restricted the use of a pinion gear to a size larger than the smallest sized pinion used on many of the small engine installations for this type of drive. Further, the interaction of the helical splines was such as to cause a severe axial load on the stop mounted to the power shaft, so as to result in some breakage of the shaft under these conditions. Also, the bearing sleeve had to be brazed to the body which is an expensive process and has caused problems, such as breaking loose from the body to which it is brazed.

U.S. Pat. No. 4,019,393 by Mortensen, also assigned to the assignee hereof, provided engine starter gearing with a dentil type overrunning clutch that assured high torque transmitting capabilities and was further provided with a third sleeve which permitted collapsing of the internal starter gear members to enable the rotary thrust loads to be absorbed by a resilient member internal of the starter gearing. By providing the internal members to cause the torsional shock to be absorbed by the resilient member, it was possible to eliminate the bearing sleeve and thereby allow starter gear usage in applications theretofore unable to be serviced. The third sleeve member utilized a straight spline to enable the rotary thrust energy to be transmitted to the resilient member thereby eliminating the need of a bearing member under the pinion gear. However, in practice, space requirements for such engine starter gearing usually require use of the embodiment of the invention of the aforesaid U.S. Pat. No. 4,019,393 that was illustrated in FIG. 2 thereof, an embodiment requiring the use of a complex and expensive one-piece load bearing housing member with a load bearing helical spline on the inside surface thereof.

SUMMARY OF THE INVENTION

In order to solve the problems of the various prior art devices described above, there is provided improved engine starter gearing of the aforesaid type which can be installed in locations where space is quite limited, particularly in locations where space extending along the longitudinal axis of such engine starter gearing is quite limited. Further, the engine starter gearing of the present invention is designed to absorb the major compressive loads applied thereto parallel to the longitudinal axis thereof by the sleeve members of such engine starter gearing rather than by the housing member thereof, thus, permitting the use of a simple, lighter weight and less expensive housing member in relation to those of the prior art as exemplified by FIG. 2 of the aforesaid U.S. Pat. No. 4,019,393.

Accordingly, it is an object of the present invention to provide an improved engine starter drive which is suitable for smaller engine installations.

It is also an object of the present invention to provide a lower cost small pinion non-indexing engine starter drive.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
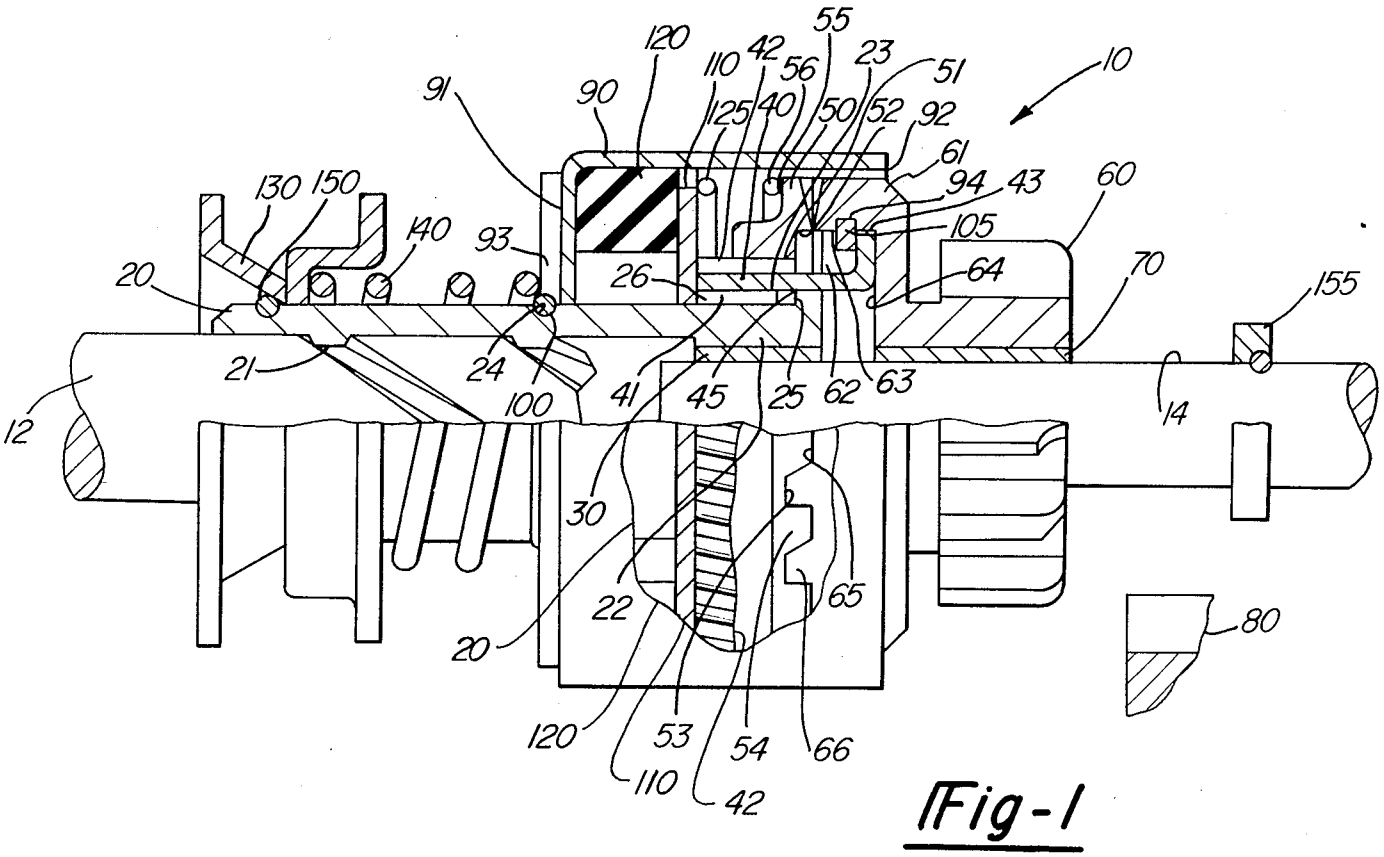
FIG. 1 is a partly elevational, partly sectional, partly broken away view of the preferred embodiment of the present invention.
Figure 2:
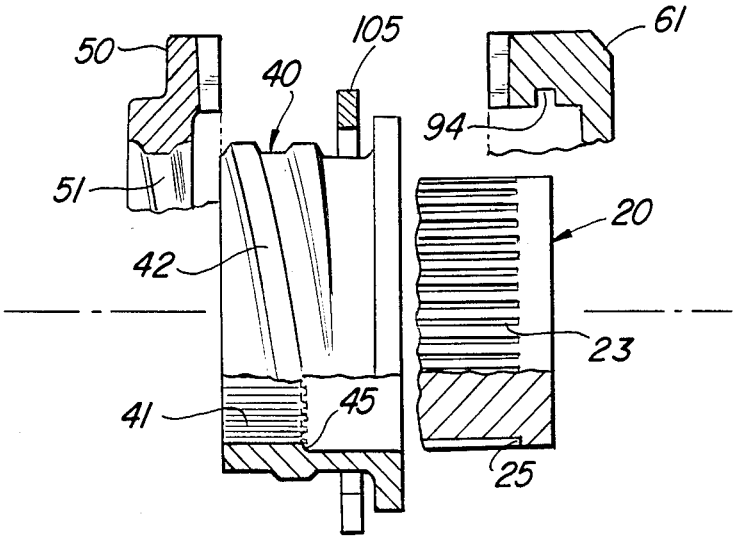
FIG. 2 is an exploded orthographic view of the preferred embodiment of the present invention showing the interaction of splines for permitting axial movement.

Referring now to the drawing, there is illustrated the preferred embodiment of the present invention which is starter gearing for an engine, the starter gearing being generally designated by the numeral 10, and being mounted on a power shaft 12 of a starter motor (not shown). The starter gearing 10 includes an elongated sleeve member 20 connected to the shaft 12 by helical splines 21 so as to be axially and rotatably movable relative to the shaft 12. The external surface of the forward or right-hand (in the orientation shown in the drawing) extremity of the elongated sleeve member 20 has a straight spline 23 formed thereupon. The forward or right-hand (in the orientation shown in the drawing) extremity 22 of the elongated sleeve member 20 is supported by a bearing member 30 which, in turn, is slidably supported on a reduced diameter portion 14 of the power shaft 12. The straight spline 23 has a shoulder portion 25 at its most forward extremity for a purpose to be described later. The bearing member 30 enables the forward portion 22 of the elongated sleeve member 20 to transmit the torsional loads without excessively deflecting as a result of the smaller power shaft diameter in the forward area of the elongated sleeve member.

Coaxially disposed with respect to the elongated sleeve member 20 is an annular sleeve member 40 with straight splines 41 on the inner surface of the annular sleeve member 40 and helical splines 42 on the external surface of the annular sleeve member 40. The annular sleeve member 40 further has a radial recess at the forward end 43 thereof extending radially inwardly of the inner surface of the annular sleeve member 40 beyond the straight splines 41. A shoulder 45 of the annular sleeve member is positioned within the radial recess and is mutually engageable with the shoulder portion 25 of the elongated sleeve member 20. The shoulder 45 of the annular sleeve member 40 abuts the shoulder portion 25 of the elongated sleeve member 20 during the overrunning mode and prevents the annular sleeve member 40 from bearing against a pinion member 60 due to a reactionary load created during the overrunning mode of operation. A driving clutch sleeve member 50 is adapted to be threaded to the helical splines of the annular sleeve member 40 by helical splines 51 on the inside surface of the driving clutch sleeve member 50 which engage the helical splines 42 of the annular sleeve member 40 and the driving clutch sleeve member 50 and is further adapted to move axially and rotatably with respect to the annular sleeve member 40. The driving clutch sleeve member 50 has a radial recess 52 at the forward end, the recess being inwardly of the inside surface of the driving clutch sleeve member 50. The driving clutch sleeve member 50 further has a forward face 53 with torque transmitting dentil teeth 54 and a shoulder portion 55 on the outside diameter adapted to receive a biasing load from a spring 56.

The pinion member 60 is slidably supported on a bearing 70 mounted to the reduced diameter portion 14 of the power shaft 12. The pinion member 60 is adapted for movement into and out of engagement with the engine gearing 80. A driven clutch member 61 is integrally formed with the pinion member 60 at the left most extension thereof as illustrated in the drawing. The driven clutch member 61 is formed to provide an annular or circular recess 62 radially inwardly of an inside bearing surface 63 of the driven clutch member 61. The annular recess adjacent an inner shoulder 64 and the radial recess 62 is adapted to provide a clearance for the forward movement of the forward end 22 of the elongated sleeve member 20 when the annular sleeve member 40 is pushed rearward into a washer 110 that bears against a resilient cushion.

The driving and driven clutch members 50 and 61 have opposing faces 53 and 65, respectively, and the opposing faces 53 and 65 are provided with complementary mutually engageable inclined torque transmitting dentil teeth 54 and 66, respectively. The dentil teeth 54 and 66 are of the sawtooth variety and provide a one-way overrunning clutch connection, as is known in the art.

A barrel-shaped housing 90, having a closed end 91 and an opposite open end 92 is reinforced at its closed end by a washer 93 and is slidably supported at its closed end on the external surface of the elongated sleeve member 20. A lock ring 100 is seated in a notch 24 in the elongated sleeve member 20 adjacent to one end of the housing and establishes the left most extremity of the washer 93 and, thereby, the left most extremity of the barrel-shaped housing 90. A second lock ring 105 is seated in a notch 94 on the inside of the driven clutch member 61 and has sufficient radial length to engage the forward end 43 of the annular sleeve member 40 between the second lock ring and the driven clutch member 61 and thereby confine the clutch elements within the housing cavity. The rearward end of the straight splines 23 on the forward extremity of the elongated sleeve member 20 provides a shoulder portion 26 which abuts the washer 110 which is slidably journalled on the elongated sleeve member 20. A resilient cushion 120 which is annular in configuration and which is preferably of an elastically deformable material, such as rubber, is compressively confined between the closed end 91 of the housing and the washer 110. A resilient spring member 125 is compressively confined between the washer 110 and the driving clutch sleeve member 50 to provide an axial force urging the driving and driven clutch members 50 and 61 into an engaged position.

Means for moving the starter gearing assembly toward or away from the engine gear may include a conventional solenoid, air or hydraulic cylinder actuated lever, not illustrated, connected to a shift collar 130, which is coupled to the closed end 91 of the barrel-shaped housing 90 by resilient means in the fonm of a compressively confined spring 140. A stop ring 150 limits the leftward movement of the shift collar 130 under the influence of the compression spring 140 and, thus, defines the yoke end of the elongated sleeve member 20. A stop 155 is provided on the power shaft 12 to prevent the barrel-shaped housing 90 from overtravelling when moved forward into the engaged position with the engine gearing 80 of the engine.

Thus, the interrelationship between the annular sleeve member 40, the elongated sleeve member 20, the pinion member 60, and the washer 110 is operative to provide an axially substantially solid interconnection, while the interrelationship of the washer 110, the resilient cushion 120, and the closed end 91 of the barrel-shaped housing 90 establishes an axially substantially constant position of the barrel-shaped housing 90 relative to the annular sleeve member 40.

OPERATION

In operation, when it is desired to start the engine, the starter gearing 10 is shifted to the right, via a positioning mechanism (not shown) which is connected to the shift collar, along the power shaft 12, so that the pinion member 60 engages the engine gearing 80. The shaft is rotated by a starting motor and transmits torque through the helical splines on the power shaft and the inner surface of the elongated sleeve member 20 to the straight splines 23 on the exterior of the forward portion of the elongated sleeve member, to the straight splines 41 on the inside of the annular sleeve member 40, from the straight splines 41 on the inside of the annular sleeve member 40 to the helical splines 42 on the outer surface of the annular sleeve member 40, from the helical splines 42 on the outside of the annular sleeve member 40 to the helical splines 51 on the inner surface of the driving clutch sleeve member 50, through the mutually engageable inclined dentil torque transmitting teeth 54 and 66 to the driven clutch sleeve member, to the pinion member 60 of the driven clutch member 61 and finally to the engine gearing 80. As the engine fires and becomes self-operating, the engine gearing 80 will now drive the pinion member 60 at a speed greater than that of the speed of the power shaft 12. The mutually engageable dentil clutch teeth 54 and 66 will slip and overrun at this point so that the starting motor is not driven at the high engine speed. This will result in the driven clutch member 61 forcing the driving clutch sleeve member 50 leftwards or backwards along the helical splines 42 and 51 between the outer surface of the annular sleeve member 40 and the inner surface of the driving clutch sleeve member 50, against the compression of the resilient spring member 125. The rearward movement of the driving clutch sleeve member 50 causes a reactionary force to be developed as a result of the mutually engageable helical splines between the annular sleeve member 40 and the driving clutch sleeve member 50. This reactionary force causes the annular sleeve member 40 to be forced between the driven clutch member 61. The mutually engageable shoulders 25 and 45 on the elongated sleeve member 20 and the annular sleeve member 40 limit the forward movement of the annular sleeve member 40, thereby limiting the axial thrust on the driven clutch member due to the movement of the annular sleeve member.

The initial high peak torque required when starting the engine is absorbed by the resilient cushion 120 by the thrust action of the helical splines 21 on the elongated sleeve member 20, causing the elongated sleeve member 20 to overtravel the assembly that includes the driving clutch sleeve member 50 and the driven clutch member 61, thus, compressing the resilient cushion 120 in a direction that extends along the longitudinal central axis of the starter gearing 10. Thus, the torque that is imposed on the starter gearing 10 during starting is transferred from the elongated sleeve member 20 to the driven clutch member 61 and the pinion member 60 through the interengaging straight splines 23 and 41, the interengaging helical splines 42 and 51, and the interengaging dentil teeth 54 and 66. This results in forward thrust loads on the helical splines 51 which ensures engagement of the dentil teeth 54 and 66, and these thrust loads are restrained by the second lock ring 105. Thus, these thrust loads are restrained by the driven clutch member 61 by virtue of the engagement of the second lock ring 105 in the notch 94 in the driven clutch member 61, thereby ensuring that these thrust loads are not imposed on the barrel-shaped housing 90, as in the case of the starter gearing of the embodiment of FIG. 1 of the aforesaid U.S. Pat. No. 4,019,393 (Mortensen), and further ensuring that such loads are not imposed on the stop 155.

Since, by virtue of the construction described, the barrel-shaped housing 90 of the starter gearing 10 is not subject to thrust loads, it can be manufactured in a very lightweight form, even from various types of thermoplastic materials. This serves to reduce the cost of the starter gearing relative to its prior art counterparts and, since weight reduction is an overall design priority in automotive design, the reduced weight of the starter gearing contributes to other cost savings and/or performance increases in the vehicle in which it is installed.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A starter gearing comprising:

a housing;

a shaft rotatably mounted to said housing;

a driven clutch member mounted coaxially with said shaft, said driven clutch member having radially extending gear teeth on one end portion and axially extending dentil clutch teeth on the opposite end portion;

a driving clutch member mounted adjacent said driven clutch member, said driving clutch member having one end portion and an opposite end portion, said one end portion having axially extending dentil clutch teeth, said dentil clutch teeth being mutually engageable with said dentil clutch teeth of said driven clutch member for transmitting torque between said driving clutch member and said driven clutch member;

an annular sleeve member coaxially disposed with said driving clutch member, said annular sleeve member having one end portion and an opposite end portion, said annular sleeve member further comprising:

means for permitting axial movement of said annular sleeve member with respect to said shaft;

means for limiting axial movement of said annular sleeve member with respect to said shaft; and means for permitting axial and rotatable movement of said driving clutch member with respect to said annular sleeve member;

means for maintaining engagement between said dentil clutch teeth of said driving clutch member and said dentil clutch teeth of said driven clutch member for transmitting torque therebetween;

means for axially and rotatably translating said annular sleeve member, driving clutch member and driven clutch member along said shaft; and restraining means secured to said driven clutch member for restraining thrust loads on said means for permitting axial and rotatable movement of said driving clutch member with respect to said annular sleeve member during rotational and axial movement of said driving clutch member with respect to said annular sleeve member and to thereby avoid the imposition of such thrust loads on said housing.

2. The starter gearing as claimed in claim 1 wherein said means for permitting axial and rotatable movement of said driving clutch member with respect to said annular sleeve member further comprises:

a first helical thread on the outside surface of said annular sleeve member; and a second helical thread on the inside surface of said driving clutch member, said second helical thread being adapted to mutually engage said first helical thread on said annular sleeve member for communication therewith.

3. The starter gearing as claimed in claim 1 wherein said means for permitting axial movement of said annular sleeve member with respect to said shaft comprises:

an elongated sleeve member coaxially mounted to said shaft, said elongated sleeve member having one end portion and an opposite end portion said one end portion having a straight spline interposed said annular sleeve member and said elongated sleeve member; and a straight spline on said opposite end portion of said inside surface of said annular sleeve member, said straight spline being adapted to mutually engage said straight spline on said one end portion of said elongated sleeve member for communication therewith.

4. The starter gearing as claimed in claim 2 wherein said means for limiting axial movement of said annular sleeve member with respect to said shaft further comprises:

a radially inward annular recess on said inside surface of said one end portion of said annular sleeve member, said annular sleeve member further having a shoulder portion in said radially inward annular recess;

a radially outward annular shoulder portion on said one end portion of said elongated sleeve member, said radially outward annular shoulder portion being mutually engageable with said shoulder portion in said annular sleeve member; and a radially inward annular recess on said inside surface of said driven clutch member, said radially inward annular recess being receivable to said elongated sleeve member when said elongated sleeve member axially translates.

5. The starter gearing as claimed in claim 1 wherein said means for permitting axial and rotatable movement of said driving clutch member with respect to said annular sleeve member further comprises:

a first helical thread on the inside surface of said annular sleeve member;

a second helical thread on the outside of said opposite end portion of said driving clutch member, said second helical thread being adapted to mutually engage said first helical thread on the inside surface of said annular sleeve member;

a radially inward recess on said inside surface of said annular sleeve member, said radially inward recess being receivable to said opposite end portion of said driven clutch member when said driven clutch member axially translates; and second means for retaining said driven clutch member adjacent said driving clutch member.

6. The starter gearing as claimed in claim 1 wherein said means for permitting axial movement of said annular sleeve member with respect to said shaft comprises:

an elongated sleeve member having one end portion and an opposite end portion, said opposite end portion being coaxially mounted to said shaft, said one end portion having a straight spline on the outside surface interposed said annular sleeve member; and a straight spline on the inside surface of said annular sleeve member, said straight spline being adapted to mutually engage said straight spline on said outside surface of said one end portion of said elongated sleeve member for communication therewith.

7. The starter gearing as claimed in claim 6 wherein said means for maintaining engagement between said dentil clutch teeth of said driving and said dentil clutch teeth of said driven clutch member further comprises:

first resilient cushion means disposed within said housing adjacent said opposite end portion of said elongated sleeve member;

an annular washer member interposed said first resilient cushion means and said annular sleeve member;

second resilient spring means interposed said washer member and said driving clutch member.

8. The starter gearing as claimed in claim 1 wherein said driven clutch member comprises:

an inside surface and a notch in said inside surface, and wherein said restraining means comprises a lock ring positioned in said notch, said lock ring engaging said annular sleeve member to fixedly position said annular sleeve member with respect to said driven clutch member.

* * * * *

UNITED STATES PATENT AND TRADEMARK OFFICE

CERTIFICATE OF CORRECTION

PATENT NO. : 4,744,258

DATED : May 17, 1988

INVENTOR(S) : Nicholas A. Volino

It is certified that error appears in the above-identified patent and that said Letters Patent is hereby corrected as shown below:

Column 4, line 36, delete "fonm" and insert ---- form ----.

Signed and Sealed this

Twenty-ninth Day of November, 1988

*Attest:*

DONALD J. QUIGG

*Attesting Officer*

*Commissioner of Patents and Trademarks*